US005846481A

United States Patent [19]

Tilak

[11] Patent Number: 5,846,481

[45] Date of Patent: Dec. 8, 1998

[54] MOLTEN ALUMINUM REFINING APPARATUS

[76] Inventor: Ravindra V. Tilak, 5261 Nantucket La., Anaheim, Calif. 92807

[21] Appl. No.: 850,341

[22] Filed: May 2, 1997

Related U.S. Application Data

[63] Continuation of Ser. No. 601,249, Feb. 14, 1996, abandoned.

[51] Int. Cl.[6] ..... C21C 7/00

[52] U.S. Cl. ..... 266/217; 266/235; 266/216

[58] Field of Search ..... 266/237, 216, 266/217, 225, 235

[56] References Cited

U.S. PATENT DOCUMENTS

| | | | |
|---|---|---|---|
| 3,645,520 | 2/1972 | Acre et al. | 266/225 |
| 3,743,263 | 7/1973 | Szekely | 266/217 |
| 5,234,202 | 8/1993 | Pelton | 266/235 |
| 5,364,078 | 11/1994 | Pelton | 266/235 |

*Primary Examiner*—Scott Kastler

[57] ABSTRACT

An improved molten aluminum refining apparatus in which the refining gas passageway is defined by a helical groove in the rotor shaft and sleeve for heating gas by contact with the sleeve as it flows toward the rotor to generally the temperature of the melt; which comprises a stator surrounding the sleeve and occupying a portion of the surface of the molten aluminum, and wherein the vessel comprises side walls that diverge upwardly at an angle of from about 5 degrees to about 16 degrees for permitting the gas bubbles to expand without substantial coalescence as the bubbles move upwardly in the melt reducing the metallostatic pressure on the respective bubbles.

19 Claims, 1 Drawing Sheet

MOLTEN ALUMINUM REFINING APPARATUS

CROSS-REFERENCE TO RELATED APPLICATION

This is a continuation of U.S. patent application Ser. No. 08/601,249, Filed Feb. 14, 1996, now abandoned, to which priority is claimed.

FIELD OF THE INVENTION

This is an improvement in apparatus for refining molten aluminum for use in the manufacture of virgin aluminum and recycled or partially recycled aluminum and its alloys.

BACKGROUND OF THE INVENTION

Molten aluminum, as derived from most common sources, such as primary metal, scrap and re-melt ingot, usually must be purified before being cast into ingots, sheets or bars. This may be done by bubbling an inert gas, i.e., nitrogen or argon, through the aluminum in molten form. In some embodiments, a halogen gas, usually chlorine, is added, or the halogen gas may be used alone for such purification purposes. This type of treatment can remove dissolved hydrogen, alkali metals such as sodium, potassium and lithium, alkaline earth metals such as calcium, and small solid particles such as aluminum oxide and other nonmetallic inclusions. The effectiveness of a given volume of gas in such treatment is increased by reducing the bubble size of the gas in the molten aluminum, thereby increasing the total gas-metal surface area. The effectiveness of the gas bubbles is also increased by dispersion of said gas bubbles throughout the body of molten aluminum to be treated. One very effective way of both making small bubbles and dispersing them is by the use of a spinning nozzle positioned in the body of molten aluminum. Commercial systems are available for this purpose. The refining rate of such a spinning nozzle system can be increased by increasing the process gas flow rate employed therein. It is usually also necessary to increase the nozzle rotating speed to continue the desired making of small bubbles and the dispersing of said small bubbles throughout the molten aluminum in the refining zone of the system. Such increases in gas flow and nozzle rotating speed are usually accompanied by increased vortexing and turbulence on the surface of the molten aluminum. The maximum refining rate of a given refining system, however, is limited by the maximum vortexing and surface turbulence or roughness that can be tolerated therein.

Basically, the process referred to involves the dispersion of a sparging gas in the form of extremely small gas bubbles throughout a melt. Hydrogen is removed from the melt by desorption into the gas bubbles, while other nonmetallic impurities are lifted into a dross layer by flotation. Hydrogen transfer from the melt to the inside of the inert gas bubbles is driven by the difference of the partial pressures. Hydrogen has a high diffusivity in aluminum melts and the transport reaction is essentially interface controlled. The higher the interfacial area, the shorter is the time required to achieve a given degree of degassing. Also, the higher the interface area, the greater is the chance of encounter and entrapment of the inclusion by the bubble. Thus, the higher the surface area, the greater is the refining efficiency. The dispersion of the sparging gas is accomplished by the use of rotating gas distributors, which produce a high amount of turbulence within the melt. The turbulence causes the small nonmetallic particles to agglomerate into large particle aggregates which are floated to the melt surface by the gas bubbles. The turbulence also causes small gas bubbles to collide and grow. This turbulence in the metal also assures thorough mixing of the sparging gas with the melt and keeps the interior of the vessel free from deposits and oxide buildups. Nonmetallic impurities floated out of the metal are withdrawn from the system with the dross while the hydrogen desorbed from the metal leaves the system with the spent sparging gas.

The rotating gas distributor has, among its other features of construction, a shaft and a vaned rotor (coupled to the shaft) and a vaned stator which interact to provide a desirable bubble pattern in the melt. The device, when in operation, induces flow patterns in the metal in the vicinity of the device such that the gas bubbles which are formed, are transported along a resultant flow vector which is radially outward with a downward component relative to the vertical axis of the injection device. These flow patterns have several advantageous effects. First, essentially vertical stirring is provided in the body of the melt, whereby a downwardly directed flow along the device, in combination with the rotating vanes, causes subdivision of the gas into small discrete gas bubbles. Second, the rapid conveyance of the gas bubbles away from the point of introduction into the melt prevents bubble coalescence in the zone where the gas bubble concentration is the highest. Third, the gas residence time of the well-dispersed gas bubbles in the melt is prolonged, because the gas bubbles do not immediately upon formation, rise to the surface under the influence of gravity.

Apparatus of the type referred to above generally comprise a vessel that is provided with an inlet for aluminum, an outlet for molten metal and gases and at least one rotating gas distributing means disposed in the vessel. While there are many variations, the gas distributing means generally comprises a rotatable shaft coupled to drive means at its upper end and attached to a vaned circular rotor at its lower end. The rotor is thus mounted for rotation and rotates closely adjacently to a stator, there being a small space provided between the rotor and stator. A passageway is provided for conveying refining gas to the rotor. The refining gas is discharged into the body of molten aluminum by way of the small clearance between the rotor and stator. Refining gas is fed into to the upper end of the passageway under sufficient pressure to be injected into the vessel. Devices generally of this type are depicted and described in the following United States patents, the relevant disclosure of which is incorporated herein by reference for describing the background of the present invention in greater detail than is warranted here.

| U.S. Pat. No. | Inventor(s) | Date |
|---|---|---|
| 3,743,262 | Szekely | 07/03/1973 |
| 4,040,610 | Szekely | 08/09/1977 |
| 5,158,737 | Stein | 10/27/1992 |
| 4,203,581 | Pelton | 05/20/1980 |
| 4,290,588 | Pelton | 09/22/1981 |
| 5,234,202 | Pelton | 08/10/1993 |

Excessive surface turbulence is undesirable in a refining system for several reasons. The increased metal surface area that is produced thereby leads to higher reaction rates with any reactive gas that might be present. For example, oxygen from air will react to form aluminum oxide films, and water vapor from the air will react to form hydrogen in the metal and oxide films. Furthermore, when solid particles are carried to the molten metal surface by the refining gas bubbles, surface turbulence may interfere with their desired separation from the bubbles and their incorporation into the floating dross layer formed over the body of molten aluminum. Excessive turbulence may also cause floating dross to be re-dispersed into the molten aluminum. Besides surface turbulence, surface and subsurface vortexing is also undesirable inside the reaction vessel. The presence of vortexing, especially along the central vertical axis, tends to capture and suck the dross and slag particles back into the melt, thereby internally increasing the loading on the refining apparatus. The problem is severe, especially for "in-line" treatment systems with high metal flow rates that provide nominal metal residence time of less than five minutes inside the reaction vessel. While the quantitative effects of excessive surface vortexing and turbulence are difficult to measure, it is well-known and generally recognized that high vortexing and surface turbulence are undesirable, and those schooled in the art have sought to limit such surface vortexing and turbulence.

One result of increasing the rotational rate of the rotor in the body of molten metal and/or increasing gas flow rates in the refining apparatus of the prior art is the formation of a fairly well defined generally torroidal flow of only a portion of the molten aluminum within the body of molten aluminum, leaving a substantial portion of the body of molten aluminum unstirred and essentially untreated. The formation of the torroidal flow is discussed and depicted in U.S. Pat. No. 3,743,263 to Szekely. The formation of torroidal flow in prior art devices tends always to result in a downflow of aluminum and, consequently, slag or dross in the immediate vicinity of the stator. Thus, the apparatus is to a small degree, at least, self-defeating in that impurities may actually be introduced or reintroduced into to the molten aluminum. The combined actions of vortexing and torroidal flow render only limited refining efficiency available in the devices of the prior art. The only means available to reduce vortexing and deleterious effects of torroidal flow in all of the devices of the prior art is to reduce the rotational velocity of the rotor. However, at lower rotor speeds, fragmentation of the gas stream into fine bubbles is not optimum and, therefore, a fine bubble dispersion with a large surface area is not achievable.

It will be apparent from the foregoing and from a study of the prior art that there remains a need for an improved molten aluminum refining apparatus to maximize the refining action of the gas and to prevent the introduction or re-introduction of impurities from the slag or dross layer that forms on top.

It is an object of this invention to provide an apparatus for refining molten aluminum that maximizes the refining effectiveness of the well-known gas injection refining method and eliminates the introduction of impurities in the dross or slag into the body of the aluminum melt both for "batch type" and "continuous-in-line type" devices.

SUMMARY OF THE INVENTION

The present invention is an improvement in molten aluminum refining apparatus that comprises a vessel for holding molten aluminum during refining and at least one gas distributing means disposed in the vessel, said distributing means comprising a rotatable shaft extending through a cylindrical sleeve, said shaft being coupled to drive means at its upper end and attached to a rotor at its lower end and means defining passageway conveying refining gas to the rotor. According to one facet of the present improvement, the means defining the refining gas passageway comprises said shaft having formed in the surface thereof grooves that define a gas flow path that is greater in length than the length of the shaft, the inner surface of the cylindrical sleeve further defining said refining gas passageway. A convenient configuration is provided when the rotor shaft has formed therein at least one helical groove defining the refining gas passageway.

In another facet, the invention is an improvement in a molten aluminum refining apparatus of the type described above and wherein the improvement comprises a stator surrounding the sleeve and occupying a portion of the surface of the molten aluminum. It is convenient and preferred that the stator floats on the aluminum when the rotor is not in motion and attains an equilibrium suspended position on the sleeve when the rotor is in motion. The equilibrium position of the stator is at a balancing point where the upward buoyancy force on the stator is matched by the downward force on the stator due to the melt vortexing and the torroidal flow of liquid aluminum, both affecting a metal velocity vector pointing downward.

In yet another facet, the improvement in the apparatus as described comprises an arrangement wherein the vessel has a floor and walls and wherein at least a portion the wall surface of the vessel diverges from vertical upwardly away from the floor. Preferably, the walls of the vessel diverge upwardly with a net upward divergence angle of from about five or 6 degrees to about 16 degrees, optimally about 10–11 degrees.

DESCRIPTION OF THE PREFERRED EMBODIMENT

Figure 1:
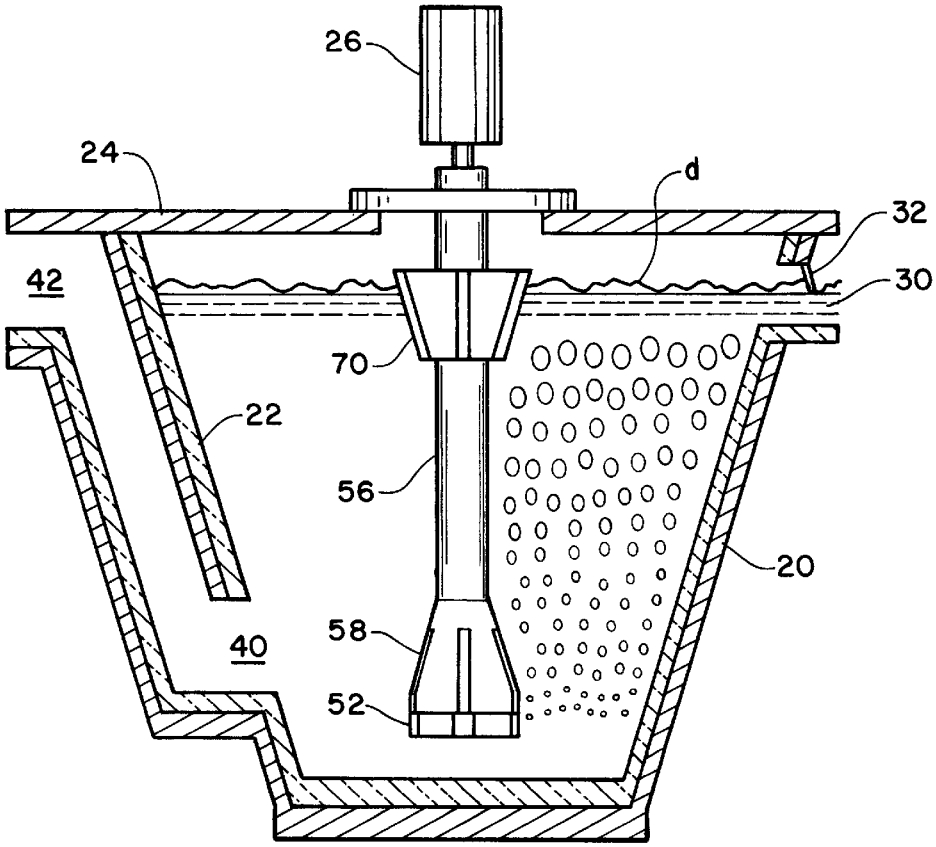
FIG. 1 is a generally schematic depiction in vertical cross-section of the apparatus of this invention illustrating the features of this invention and the advantages thereof. Heaters for maintaining the temperature of the molten aluminum are not explicitly depicted but may be included in the apparatus if desired; however, they are not part of the present invention.

Referring to FIG. 1, the outer wall 20 of the furnace is typically made of steel. Inside of wall 20 is refractory vessel 22 of low thermal conductivity insulating block and a castable alumina impervious to the molten aluminum. Other refractory materials may be used, of course, but a typical castable alumina is 60% to 96% $Al_2O_3$, 0.2% $Fe_2O_3$, and balance other materials. The refractory wall of the vessel 22 is, over all, of low thermal conductivity and provides insulation which minimizes or eliminates the need for adding heat to the aluminum in the vessel. The outer structure is completed with furnace cover or roof 24 and a superstructure (not shown), which supports the gas distributor and an electric motor 26. The refining operation begins with molten metal entering the vessel through an inlet port 30 which may be lined with silicon carbide blocks or other refractory.

The melt of aluminum is vigorously stirred and sparged with refining gas through the rotating gas distributor indicated generally at 50. The rotation of the rotor 52 of the distributor is counterclockwise; however, the circulation pattern induced in the melt by the distributor has a vertical component. Typically, in the prior art, vortex formation was reduced by offsetting the symmetry of the working zone generally in the center of the vessel. Baffles have also been used in an effort to minimize the vortex formation.

The refined metal enters exit pipe 40 schematically depicted at the left in FIG. 1 and is conducted into an exit compartment 42. Compartment 42 is separated from main body of aluminum in the vessel 22 by a refractory wall of graphite block and/or silicon carbide block. The bottom of the furnace may be lined with graphite plate.

The dross d floating on the metal is caught by a blade or block 32 acting as both a baffle and a skimmer and collects on the surface of the melt close to inlet port 30 from where it can easily be removed. The spent sparging gas leaves the system through the entrance 30. Head space protection over the melt is provided by introducing an inert gas such as argon into the furnace through an inlet pipe or along with the sparging gas.

Heat is supplied to the furnace in any traditional or conventional manner. Typically nickel-chromium electric resistance heating elements are inserted into dual function (lining+heating) graphite blocks that are kept in place in contact with the molten aluminum.

Roof 24 is in a sealed relationship with the rest of the furnace through and is protected from the heat by several layers of insulation. An example of the kind of insulation used is aluminum foil backed fibrous aluminum silicate.

A motor 26 is depicted in FIG. 1. Along with the motor, temperature control, transformer, and other conventional equipment are provided to drive the distributor and operate the apparatus, all as described in considerable detail in the prior art incorporated herein by reference. Sealing of inlet and outlet ports, piping, and other equipment to protect the integrity of a closed system is also conventional and not shown.

Although there is one rotating gas distributing means 50 shown in the described apparatus, two or more can be used provided the size of the apparatus is increased proportionately. The gas distributor or gas injection device shown is comprised of a rotor 52 having vanes 54 and channels 56 between the vanes. Rotor 52 is rotated by means of a motor 26 through shaft 60 to which it is attached. Shaft 60 is shielded from the melt by hollow sleeve 56 and hollow stator 58 to which the sleeve is secured. The outer surface of the stator may be smooth or vaned. There is sufficient clearance between rotor 52 and stator 58 to permit free rotation of rotor 52 and to permit outward free flow of the process gas. The internal design of the device is such that there is a helical passageway 62 defined by one or more helical grooves formed in the external surface of the shaft 60 and the inner surfaces of sleeve 56 through which gas can be introduced and forced out into the clearance between rotor 52 and stator 58. Shaft 60 and sleeve 56 and stator 58 have the same axis and thus the passageway surrounds this axis. The shaft 60 and the rotor have axes that are coaxial with the axis of the stator and sleeve. Any conventional means for supplying gas to the upper end of the passageway under sufficient pressure to be injected into the vessel and melt is provided but are not shown. The gas is heated by contact with the sleeve as it flows toward the rotor such that the temperature of the gas at the time it is injected into the melt is very close to the temperature of the melt. This is one of the very important features of the invention, as will be discussed below.

A typical vessel may be from about four feet to about six feet in diameter and depth. Typical gas injection means may be from about 4 to 8 inches in diameter, with or without a taper between the rotor and the sleeve. Typical speeds for the rotor are 400 to 600 revolutions per minute with a 2 to 5 standard cubic feet per minute gas throughput.

Returning now to FIG. 1, it will be noted that the walls of the vessel taper outwardly from the floor. This is also an important concept and feature of the present invention.

One of the serious limitations of the prior art resulted from the coalescence of gas bubbles after they were injected into the melt of aluminum. Gas coalescence places a severe limitation on the rate of refining. Coalescence produces many fewer and larger gas bubbles as the bubbles rise toward the surface. Large bubbles increase the turbulence at the interface between the molten aluminum and the dross layer, causing some back-flow or introduction back into the aluminum of the impurities of the dross. Smaller bubbles arriving at the top of the aluminum minimize this source of contamination. More important, as the bubbles coalesce into larger bubbles the gas-to-molten metal surface area is greatly reduced. This results in a very substantial reduction in the rate of refining reaction because the reaction takes place only at the gas-metal interface. As previously described, hydrogen is removed from the melt by desorption into the gas bubbles, while other nonmetallic impurities are lifted into a dross layer by flotation. Hydrogen transfer from the melt to the inside of the inert gas bubbles is driven by the difference of the partial pressures. Hydrogen has a high diffusivity in aluminum melts and the transport reaction is essentially interface controlled. The higher the interfacial area, the shorter is the time required to achieve a given degree of degassing. Also, the higher the interface area, the greater is the chance of encounter and entrapment of the inclusion by the bubble. Thus, the higher the surface area, the greater is the refining efficiency. Furthermore, the probability that a given impurity domain will be contacted by and adhere to or react with a gas bubble goes down rapidly as the number of bubbles is reduced and the total interface area between the gas and metal is reduced.

Two means for reducing and substantially eliminating such gas coalescence and the resulting problems are included within the overall concept of this invention.

First, as previously described, the refining gas is preheated before it is injected into the molten metal. While other heater groove configurations may be used, it is advantageous to use the helical gas flow path as described as the preheating means for the process gas. The gas flow path, according to this concept, is defined by the outer surface of the shaft and the inner surface of the sleeve and defines a gas flow path that is greater in length than the length of the shaft. When cold gas is injected into the molten metal as fine, the gas immediately expands approximately as set forth in the ideal gas law and larger bubbles are formed. From room temperature to typical molten aluminum temperature of 1325° F., gas expands to three times its original room temperature volume at the same pressure. If the gas is the same temperature as the melt, then such expansion is avoided and large mass of gas can be introduced into the melt without deterioration of the body or upper surface of the melt by the presence of large gas bubbles.

Figure 3:
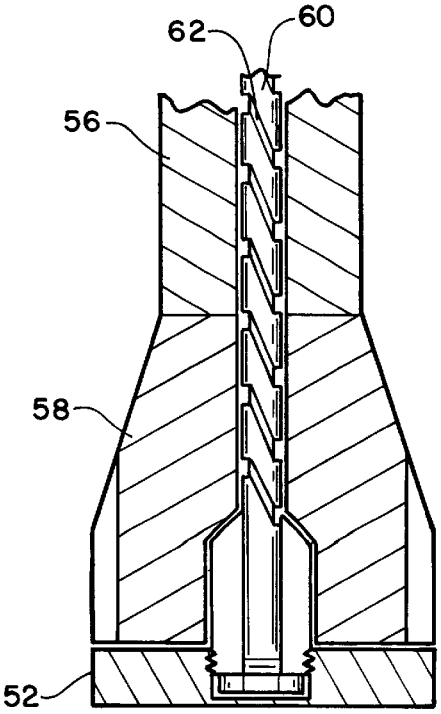
FIG. 3 is an enlarged vertical cross-sectional view of the improved gas supply arrangement of the improved gas dispersion mechanism of this invention.
Figure 2:
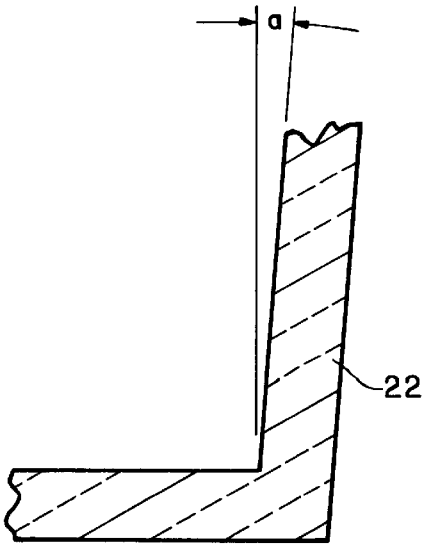
FIG. 2 is a schematic depiction of the floor and one wall of the vessel of the present apparatus depicting the angular relationship that exists between the floor and the wall.

Secondly, as depicted in FIG. 1, the walls of the vessel, or at least a portion of the wall surface of the vessel, diverge from vertical upwardly away from the floor at an angle $\alpha$, indicated in FIG. 3. The floor is depicted in the exemplary embodiment of FIG. 1 as flat and horizontal to more easily illustrate the concept of the invention but the shape of the floor is not critical. What is critical is that there be a net divergence of the walls from the vertical upwardly from the floor. Conceptually, it is simple to describe the vessel as an inverted frustocone; however, the walls need not be arcuate. While any substantial divergence of the walls will improve the processing of aluminum as described, the optimum angle of divergence of the walls, or at least some of them, from the floor is about 11±5 degrees.

Theoretically, the upward divergence angle of the walls from the floor of the vessel should be about 10.5 degrees; however, it is believed that near-optimum results can be achieved with vessels in which the net upward divergence angle of the walls is about 7 to 8 degrees from the vessel floor. The term "net upward angle of the walls" is used here to describe a vessel in which not all of the walls diverge, or do not diverge equally, from an imaginary vertical axis through the center of the vessel, but wherein at least some of the walls diverge sufficiently to provide an enlarged upper surface of the same general magnitude as that of a vessel of the same volume with one divergent wall or equally divergent walls having the net upward divergence angle. Thus, a rectangular vessel having some upwardly divergent walls having the same volume and upper surface area to floor area ratio as an inverted frustoconically shaped vessel having an upward divergent angle of 10 degrees would have a net upward divergence angle of 10 degrees.

The net upward divergence of the vessel walls is important in that it permits the gas bubbles to expand as the metallostatic pressure on the respective bubbles is reduced as the bubbles move upwardly in the melt. In the prior art, as the bubbles expanded under the lesser pressure of the upper portions of the melt, the bubbles were forced, by their increasing size, closer together. The closer the bubbles come together, the less the flow of molten aluminum between the bubbles and the greater the likelihood that two, or more, bubbles will coalesce to become larger bubbles, with the resulting problems discussed hereinbefore.

By providing an aluminum refining apparatus of the type described, namely a refining vessel, an inlet for aluminum, an outlet for molten aluminum, and gas introduction means for injecting a stream of gas bubbles into the melt in the vessel, wherein the vessel walls have a net upward divergence, the gas bubbles tend to move upwardly and outwardly and, thereby, reduce the likelihood of coalescence of the bubbles.

The problem described above of reintroduction of impurities from the dross or slag layer adjacent the stator is addressed by means of a floating stator 70, as depicted in FIG. 1. The floating stator 70 may be, and is conveniently about the same diameter as the rotor and about the height of the submerged stator 58, or it may be significantly larger. The specific gravity of the stator is sufficiently lower than the specific gravity of molten aluminum to provide floatation even in the presence of the downward vectors previously discussed. The overall density is preferably selected such that the stator floats on quiescent molten aluminum and, by reason of the downward vectors discussed, is suspended in molten aluminum when the rotor is at operational rotational velocity. Optimum density is easily determined for a given refining vessel by simple experimentation. Generally, the density of the stator overall will be in the range of from 2.0 to 2.5 gm/cm$^3$. Sufficient surface area for the collection of dross on the upper surface and removal of the injected gas must be provided, however, a comparatively large floating stator, e.g., 2 to 5 times the diameter of the submerged stator and rotor, may be used. The floating stator 70 blocks the vortex that is inherently formed as a result of the torroidal circulation of aluminum in the melt previously described and, thereby, eliminates a small stream of impurities that, in the prior art, are introduced into the melt from the dross layer adjacent the stator.

The three structures described, a gas preheater, a vessel with net upwardly diverging walls, and the floating stator virtually eliminate the most severe problems faced by users of the prior art devices as described above and in the patents incorporated herein by reference.

As sophisticated demands are imposed on molten metal cleanliness and internal structural soundness of the molten aluminum and its alloys, present day devices, with the problems mentioned above, fall short of aluminum refining capability, particularly for end aluminum applications such as aluminum foil, aerospace and defense grade aluminum forgings and extrusions bright anodized aluminum sheet, aluminum engine blocks in the automotive industries. Quality demands and pressures from aluminum end users on aluminum producers, together with the ready availability of instrumentation to detect metal uncleanliness, guarantees quick commercial exploitation of the present invention.

INDUSTRIAL APPLICATION

This invention is used in the metallurgical industries, most particularly in the casting and foundering of primary and secondary aluminum and aluminum alloys.

What is claimed is:

1. In a molten aluminum refining apparatus that comprises a vessel for holding molten aluminum during refining and at least one gas distributing means disposed in the vessel, said distributing means comprising a rotatable shaft extending through a cylindrical sleeve, said shaft being coupled to drive means at its upper end and attached to a rotor at its lower end and means defining passageway conveying refining gas to the rotor, the improvement:

wherein the means defining the refining gas passageway comprises said shaft having formed in the surface thereof grooves that define a gas flow path that is greater in length than the length of the shaft, the inner surface of the cylindrical sleeve further defining said refining gas passageway, said rotor and sleeve being so configured and constructed as to define said passageway for heating gas by contact with the sleeve as it flows toward the rotor to generally the temperature of the melt;

further comprising a stator surrounding the sleeve and occupying a portion of the surface of the molten aluminum; and wherein the vessel is so configured and constructed as to define a floor and a side walls that diverge upwardly at an angle of from about 5 degrees to about 16 degrees for permitting the gas bubbles to expand without substantial coalescence as the bubbles move upwardly in the melt reducing the metallostatic pressure on the respective bubbles.

2. The apparatus of claim 1 wherein the shaft has formed therein at least one helical groove defining said refining gas passageway.

3. The apparatus of claim 2 wherein the stator floats on quiescent molten aluminum and is suspended in molten aluminum when the rotor is at operational rotational velocity.

4. The apparatus of claim 3 wherein the walls of the vessel diverge upwardly with a net upward divergence angle of about 11 degrees.

5. The apparatus of claim 2 wherein the walls of the vessel diverge upwardly with a net upward divergence angle of about 11 degrees.

6. The apparatus of claim 1 wherein the stator floats on quiescent molten aluminum and is suspended in molten aluminum when the rotor is at operational rotational velocity.

7. The apparatus of claim 6 wherein the walls of the vessel diverge upwardly with a net upward divergence angle of about 11 degrees.

8. The apparatus of claim 1 wherein the walls of the vessel diverge upwardly with a net upward divergence angle of about 11 degrees.

9. In a molten aluminum refining apparatus that comprises a vessel for holding molten aluminum during refining and at least one gas distributing means disposed in the vessel, said distributing means comprising a rotatable shaft extending through a cylindrical sleeve, said shaft being coupled to drive means at its upper end and attached to a rotor at its lower end and means defining passageway conveying refining gas to the rotor, the improvement further comprising a fluted, freely moveable, floating stator surrounding the sleeve and occupying a portion of the surface of the molten aluminum.

10. The apparatus of claim 9 wherein the stator floats on quiescent molten aluminum and is suspended in molten aluminum when the rotor is at operational rotational velocity.

11. In a molten aluminum refining apparatus that comprises a vessel for holding molten aluminum during refining and at least one gas distributing means disposed in the vessel, said distributing means comprising a rotatable shaft extending through a cylindrical sleeve, said shaft being coupled to drive means at its upper end and attached to a rotor at its lower end and means defining passageway conveying refining gas to the rotor, the improvement wherein the vessel is so configured and constructed as to define a floor and a side walls that diverge upwardly at an angle of from about 5 degrees to about 16 degrees for permitting the gas bubbles to expand without substantial coalescence as the bubbles move upwardly in the melt reducing the metallostatic pressure on the respective bubbles.

12. The apparatus of claim 5 wherein the walls of the vessel diverge upwardly at an angle of about 11 degrees.

13. The apparatus of claim 12 further comprising a stator surrounding the sleeve and occupying a portion of the surface of the molten aluminum.

14. The apparatus of claim 13 wherein the stator floats on quiescent molten aluminum and is suspended in molten aluminum when the rotor is at operational rotational velocity.

15. The apparatus of claim 11 further comprising a stator surrounding the sleeve and occupying a portion of the surface of the molten aluminum.

16. The apparatus of claim 15 wherein the stator floats on quiescent molten aluminum and is suspended in molten aluminum when the rotor is at operational rotational velocity.

17. In a molten aluminum refining apparatus that comprises a vessel for holding molten aluminum during refining and at least one gas distributing means disposed in the vessel, said distributing means comprising a rotatable shaft extending through a cylindrical sleeve, said shaft being coupled to drive means at its upper end and attached to a rotor at its lower end and means defining passageway conveying refining gas to the rotor, the improvement wherein the means defining the refining gas passageway comprises said shaft having formed in the surface thereof grooves that define a gas flow path that is greater in length than the length of the shaft, the inner surface of the cylindrical sleeve further defining said refining gas passageway configured to expose greater surface areas of the process gas and cylindrical sleeve to each other thereby allowing greater heat transfer, said rotor shaft and sleeve being so configured and constructed as to define said passageway for heating gas by contact with the sleeve as it flows toward the rotor to generally the temperature of the melt and further comprising a fluted, freely moveable, floating stator surrounding the sleeve and occupying a portion of the surface of the molten aluminum.

18. The apparatus of claim 17 wherein the stator floats on quiescent molten aluminum and is suspended in molten aluminum when the rotor is at operational rotational velocity.

19. The apparatus of claim 17 wherein the vessel is so configured and constructed as to define a floor and a side walls that diverge upwardly at an angle of about 11 degrees for permitting the gas bubbles to expand without substantial coalescence as the bubbles move upwardly in the melt reducing the metallostatic pressure on the respective bubbles.

* * * * *